US006131407A

United States Patent [19]

Wissolik

[11] Patent Number: 6,131,407

[45] Date of Patent: Oct. 17, 2000

[54] NATURAL GAS LETDOWN LIQUEFACTION SYSTEM

[76] Inventor: Robert Wissolik, 24 Gates Ave., Chatham, N.J. 07928

[21] Appl. No.: 09/262,259

[22] Filed: Mar. 4, 1999

[51] Int. Cl.[7] ..... F25J 1/00; F25J 3/00

[52] U.S. Cl. ..... 62/606; 62/613; 62/913; 62/643

[58] Field of Search ..... 62/606, 609, 612, 62/613, 912, 913, 643

[56] References Cited

U.S. PATENT DOCUMENTS

| | | | |
|---|---|---|---|
| 3,339,370 | 9/1967 | Streich et al. | 62/912 |
| 3,608,323 | 9/1971 | Salama | 62/613 |
| 4,054,433 | 10/1977 | Buffiere et al. | 62/912 |
| 5,220,798 | 6/1993 | Nagamura et al. | 62/912 |
| 5,799,505 | 9/1998 | Bonaquist et al. | 62/613 |

FOREIGN PATENT DOCUMENTS

| | | | |
|---|---|---|---|
| 406123553 | 5/1994 | Japan | 62/912 |

*Primary Examiner*—William Doerrler
*Attorney, Agent, or Firm*—Carella, Byrne, et al; John N. Bain; William Squire

[57] ABSTRACT

A conventional air separator unit separates nitrogen, oxygen or argon merchant gas to be liquefied. Input pressurized natural gas is processed through a pressure letdown liquefaction system including gas separators for removing moisture and for drying the gas. The dried gas is then separated into large and small gas stream portions wherein $CO_2$ in the smaller portion is removed. The two portions are passed through a first heat exchanger from which the larger portion is expanded which cools it and then passed through two heat exchangers including the first exchanger, used to regenerate the $CO_2$ separator and drier and then returned to the input stream. The smaller portion is passed through the two heat exchangers to a throttle valve where the gas is liquefied and processed to a second set of heat exchangers which receive compressed separated merchant gas to be cooled by the liquefied natural gas and liquefied via an additional heat exchanger which receives cooled vapor separated from the liquefied merchant gas, the vapor being formed by a flash valve. The vapor is repetitively recycled through a compressor and passed through the second set of heat exchangers. Different embodiments are disclosed including a compander for expanding the merchant gas which is passed through the first and second set of heat exchangers and including an embodiment for supplying cold merchant gas rather than liquid merchant gas to an air separation unit for producing liquefied merchant gases.

30 Claims, 5 Drawing Sheets

LNG GENERATOR 91
LIQUEFACTION SECTION 59

NATURAL GAS LETDOWN LIQUEFACTION SYSTEM

FIELD OF INVENTION

The present invention relates to the manufacture of merchant liquid nitrogen, liquid oxygen and liquid argon utilizing an air separation unit and the refrigeration capability of natural gas expansion.

BACKGROUND OF INVENTION

Traditionally natural gas is compressed and sent down pipelines under high pressure to transport the gas to market. When the gas has arrived at its use point; the pressure of the natural gas is reduced in one or more control valves and/or pressure regulators to its final pressure for consumption. The available energy from the reduction in pressure of the natural gas is wasted in the control valves and pressure regulators as well as any small chilling effected caused by the flow of natural gas through these devices.

In the past, advantage has been taken of this wasted energy by facilities utilizing the energy and refrigeration effect of expanding the natural gas. One such facility was designed and constructed by Airco Industrial Gases' Cryoplants Division in the early 1970's in Reading, Pa. for UGI Corporation. It employed a natural gas pressure reduction station ("Letdown Station") to make liquefied natural gas ("LNG"). A majority of the natural gas entering the plant under high pressure from the transportation pipeline was cooled and sent to an expansion turbine where energy and refrigeration were generated. The remainder of the stream was subsequently cooled with the refrigeration and a portion liquefied. The liquefied portion was then passed to a storage tank as LNG product. The natural gas that was not liquefied was warmed, collected and sent to the low pressure main at a lower pressure than the high-pressure main.

Many industrial gas producers have taken advantage of LNG to reduce the power consumption in manufacturing merchant liquid products. British Oxygen Company built one such plant for Commonwealth Industrial Gases in Dandenong, Australia. In this facility, LNG at low pressure is vaporized employing warmer gaseous nitrogen at high pressure to liquefy the nitrogen gas. The power required to make the liquid nitrogen in this type of plant is greatly reduced from the power required by conventional nitrogen gas expansion merchant liquid plants that are used throughout the industrial gas producing industry employing nitrogen gas expansion. By combining a letdown station plant making LNG with a plant vaporizing LNG to make merchant gas liquids, a new type of Letdown Liquefier can be made to utilize the energy and refrigeration generating capabilities of natural gas letdown stations to make merchant liquid products.

In the mid 1980s, there was development work on a letdown station liquefaction plant to produce merchant liquid nitrogen, oxygen and argon. The design included removal of the $H_2O$ and $CO_2$ from the entire natural gas feed stream. In this concept, the majority of the natural gas was expanded with the rest liquefied. Subsequently, nitrogen was cooled by vaporizing and warming the partially liquefied natural gas. When throttled, the nitrogen became liquefied and was sent to the air separation unit to make merchant products. Integrating a letdown station liquefaction section directly with the air separation unit was also explored using air as the refrigeration sink, but this was dropped due to safely concerns with the air/natural gas processing proximity. No facility was constructed to practice this concept.

Among the objects and advantages of the present invention is to provide systems for producing liquid merchant gas such as nitrogen, oxygen and argon by employing the refrigeration capabilities of natural gas expansion and the energy recovered from letting down pressure through a letdown liquefaction process instead of a natural gas control valve or a pressure regulator.

It is among the further objects and advantages of the present invention to provide methods and systems for producing liquid merchant gases with less power consumption by recovering both refrigeration and energy from a natural gas stream.

An additional object and advantage of the present invention is to provide methods and systems for producing liquid merchant gases with additional liquid reflux generated by the inventive systems that increases the amount of product argon and oxygen.

A further object and advantage of the present invention is to provide methods and systems for producing liquid merchant gases with reduced capital expenditure resulting from recovering both refrigeration and energy from a natural gas stream.

SUMMARY OF THE INVENTION

A system for liquefying at least one of nitrogen, oxygen and argon merchant gas according to one embodiment of the present invention comprises natural gas liquefying means responsive to pressurized natural gas applied at an input thereto including first heat exchanger means for cooling the applied natural gas and including means for liquefying a first portion of the cooled natural gas including means for removing $CO_2$ solely from the first portion; and second heat exchanger means responsive to the liquefied first portion of gas applied as an input thereto for cooling and liquefying the at least one merchant gas applied to the second heat exchanger means.

In one aspect, the natural gas liquefying means includes means for expanding and cooling by the expansion a second portion of the pressurized natural gas, the first heat exchanger means for receiving the first and second portions of the pressurized natural gas in fluid isolation relative to each other and responsive to the cooled second portion applied at an input thereto for cooling the first portion of the natural gas and means for liquefying the first portion and applying the cooled liquefied first portion to the second heat exchanger means.

In a further aspect, the first heat exchanger means comprises third and fourth heat exchangers each for receiving the first and second natural gas portions in fluid isolation relation relative to each other, the third and fourth heat exchangers for successively receiving the first and second portions for cooling the first portion with the cooled second portion.

In a further aspect, the third and fourth heat exchangers receive the second portion in reverse sequential order as the first portion.

In a still further aspect, the natural gas input includes pressure letdown means for reducing the pressure of the input gas to a relatively low pressure output, the system including means for returning the first and second portions of gas to the low pressure output.

Preferably separator means are included for separating liquids from the natural gas from the input, drying means for drying the separated natural gas and means for dividing the separated, dried gas into the first and second portions and adsorption means for adsorbing and removing $CO_2$ from the first dried portion.

In a further aspect, means are included for regenerating the drying and adsorption means with the cooled natural gas after warming by the first and second heat exchanger means.

In a still further aspect, the second heat exchanger means includes a plurality of heat exchangers, the plurality of heat exchangers for successively receiving the at least one merchant gas to be liquefied and at least a portion of the plurality of heat exchangers for receiving the liquefied natural gas first portion for cooling the received at least one merchant gas.

Preferably, the plurality of heat exchangers includes at least two further heat exchangers for receiving the at least one merchant gas to be liquefied and for receiving the liquefied first portion.

In a further aspect, the at least two further heat exchangers comprise fifth, sixth and seventh heat exchangers, the fifth and sixth heat exchangers for receiving the liquefied natural gas for cooling and liquefying the at least one merchant gas in fluid isolation relation to the natural gas, the seventh heat exchanger for receiving only the at least one merchant gas.

Preferably, flash means are included for flashing the liquefied at least one merchant gas to produce vapor and liquid in the at least one merchant gas, separating means for separating the vapor from liquid in the at least one merchant gas and means for applying the separated vaporized at least one merchant gas to the seventh heat exchanger.

In a still further aspect, air separation means are included for separating the at least one merchant gas from air, compression means for compressing the at least one merchant gas and means for supplying the compressed at least one merchant gas to the second heat exchanger means.

Preferably the liquefied natural gas includes vapor and liquid natural gas and the second heat exchanger means comprises third and fourth heat exchangers, the system further including a first separator for separating the vapor from the liquid in the liquefied natural gas, means for applying the separated liquid natural gas to a second separator and means for applying the vapor and liquid natural gas from the first separator to the third heat exchanger and the output of the second separator to the fourth heat exchanger, a compressor for compressing the at least one merchant gas and for applying the compressed at least one merchant gas to the third heat exchanger for cooling by the separated vapor and liquid natural gas and for applying the cooled merchant gas from the third heat exchanger to the fourth heat exchanger for cooling by the output of the second separator.

A system for liquefying at least one of nitrogen, oxygen and argon merchant gas supplied from an air separation unit which includes means for cooling the at least one merchant gas according to a further aspect comprises natural gas liquefying means responsive to pressurized natural gas applied at an input thereto including heat exchanger means for cooling the applied natural gas and including means for liquefying a first portion of the cooled natural gas, the heat exchanger means including means responsive to the liquefied first portion of gas applied as an input thereto for cooling the at least one merchant gas applied to the heat exchanger means.

Compander means are included for expanding the at least one merchant gas and for applying the expanded at least one merchant gas to the heat exchanger means for the cooling of the at least one merchant gas, the compander means for further expanding the cooled at least one merchant gas and applying the further expanded cooled at least one merchant gas to a separator for producing a cold at least one merchant gas and for applying the cold merchant gas to the air separation unit.

More specifically in a further aspect, high-pressure natural gas from a transportation main is diverted from any conventional letdown station to a letdown liquefaction plant designed in accordance with the present invention. The entire natural gas stream is first dried through an adsorption system to remove water and mercaptans added to impart odor to the natural gas stream. Next, the natural gas stream is split into a larger stream which is used for expansion and a smaller stream which is used for liquefaction. The small stream to be liquefied is fed to a second adsorption system to remove $CO_2$. Both natural gas streams are then cooled separately in a first heat exchanger to the expansion temperature.

Prior to expansion, the larger stream is first passed through a first conventional process separator to remove small amounts of liquid hydrocarbons for the protection of the expander. The liquid hydrocarbons are warmed in the first heat exchanger to recover its refrigeration and then let-down through a control valve to a lower pressure later to be mixed back with the low pressure natural gas. The natural gas vapor from the separation is then fed to an expansion turbine where the pressure is reduced to the lower level. Energy extracted from the natural gas is recovered in an electric generator brake, and the temperature reduction caused by the expansion is employed to cool both the incoming streams in the first heat exchanger and the smaller natural gas stream in a second heat exchanger.

The smaller natural gas stream is cooled sufficiently in the second heat exchanger to produce hydrocarbon vapor and liquid when throttled through a first control valve. This mix is then passed to a second process separator. A first portion of the liquid hydrocarbons and all the vapor from the second process separator are mixed again and sent to a third heat exchanger to cool incoming nitrogen. The second portion of liquid from the second process separator is flashed through a second control valve to a lower pressure level and lower temperature before being fed into a fourth heat exchanger operating at a colder temperature level than the exit temperature from the third heat exchanger. All the natural gas streams from the high pressure main which are not expanded are fed into the third and fourth heat exchangers to be warmed to ambient temperatures employing nitrogen gas under pressure. The nitrogen gas is chilled sufficiently by the time it leaves the fourth said heat exchanger to start condensing when the pressure is at or below the critical pressure.

The natural gas exiting the third heat exchanger is at ambient temperature. It is compressed to the pressure level of the expanded natural gas stream exiting from the first heat exchanger. The remaining natural gas exiting the third heat exchanger at the low/intermediate pressure level may or may not need compression up to the level of the expanded natural gas depending upon actual process conditions. All the natural gas streams from which the $CO_2$ has been removed are then recombined and a portion of these streams are used as regeneration gas for the carbon dioxide adsorption systems. A portion of the natural gas stream that has been expanded and warmed is used to regenerate the water dryers. Then all the natural gas streams are recombined. The recombined natural gas streams are finally fed into the low pressure level natural gas distribution main for use by the customer.

The refrigeration available from the natural gas streams is utilized by cooling and liquefying nitrogen gas from an air separation plant. The air separation plant can be an industrial gas plant producing nitrogen only, nitrogen and oxygen, or nitrogen, oxygen and argon. Nitrogen gas from the air separation unit is compressed to high pressure in preparation for liquefaction. Some recycled nitrogen is also compressed. All compressed nitrogen gas streams are intercooled and after cooled in the compression phase. Cooling water, direct air-fin exchangers, natural gas for dryer regeneration, or any combination are used for inter-cooling and after-cooling.

The combined nitrogen gas streams are sent through the third and fourth heat exchangers to recover the refrigeration in the natural gas streams and the recycled nitrogen streams. In a fifth heat exchanger, only high-pressure nitrogen and recycled nitrogen exchange heat to bring the main nitrogen stream to a temperature sufficient to liquefy most of the nitrogen when it is throttled to a lower pressure. After throttling, the mixed vapor and liquid nitrogen streams are sent to a fourth separator where liquid nitrogen can be extracted. The vapor from the fourth separator is then recycled through fifth, fourth and third heat exchangers sequentially to recover its refrigeration before being recombined with the air separation plant nitrogen. Liquid nitrogen can be extracted directly from fourth separator as liquid nitrogen product to a tank, or it can be fed back into the air separation plant to "liquid assist" the air separation plant. Liquid assisting the air separation plant enables this plant to make liquid nitrogen, liquid oxygen and possibly liquid argon depending upon the type of air separation plant employed.

In another embodiment, cold nitrogen gas from the let down plant is used as a refrigerant assist to an air separation unit to provide additional liquid merchant gas product.

DETAILED DESCRIPTION OF THE INVENTION

Figure 1:
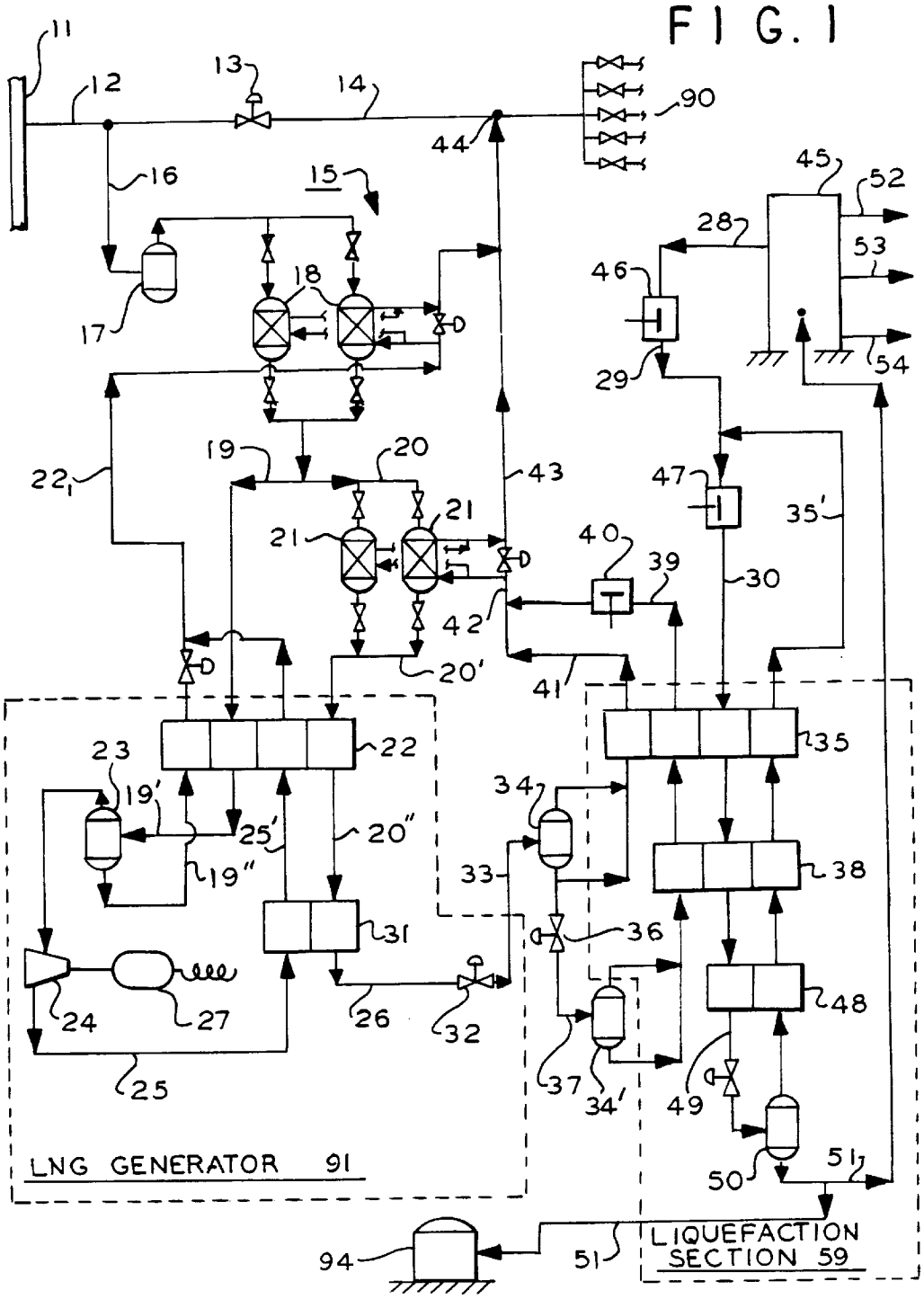
FIG. 1 is a schematic process flow diagram showing a basic letdown liquefaction plant using warm, low-pressure nitrogen makeup from an air separation unit according to one embodiment of the present invention.

In FIG. 1, a pipe 11 has an incoming stream 11 of natural gas, under high pressure, typically 350 to 1000 psig. The pressure could be lower, especially if the natural gas is being fed from a submain, but will be assumed to be 600 psig for illustrative purposes only. Natural gas for a specific customer or group of customers is withdrawn from the pipeline as shown at stream 12 and letdown through the letdown station 13 or several letdown stations to a lower pressure stream 14. The gas exits at distribution outlet 90. The pressure ratio between streams 12 and stream 14 will be at or greater than 1.5:1, and could be as high as 10/1 or more. For illustration only, the pressure for stream 14 will be assumed to be 35 psig. Letdown liquefaction system 15 of the present invention is tapped into the high and low pressure levels of the natural gas line on respective opposite sides of the station 13. Thus, natural gas flow can be directed around the letdown station 13 into the letdown liquefaction system 15.

The natural gas diversion starts with stream 16. Stream 16 feeds into a first conventional process separator 17 which removes any undesirable liquids in the natural gas stream 16. Vapor from the first process separator 17 passes to a moisture adsorption system comprising dryers 18, 18. The water dryers 18, 18 remove moisture from the natural gas to prevent hydrate formation when the natural gas is cooled later in the cycle. Mercaptans used to impart an odor to the natural gas are also removed in the dryers 18, 18.

After drying by dryers 18, 18, the natural gas is split into two stream portions, streams 19 and 20, stream 20 being smaller than stream 19. The smaller stream 20 of natural gas which has approximately 20 percent of the total natural gas flow is processed by a carbon dioxide adsorption system comprising adsorbers 21, 21 for $CO_2$ removal. The larger natural gas stream 19 is fed directly into a first heat exchanger 22 in liquid natural gas (LNG) generator 91. Generator 91 comprises heat exchangers 22 and 31, separator 23, expander 24 (and electric brake 27 driven by expander 24) and valve 32. The heat exchanger 22, as are all of the heat exchangers disclosed herein, is compartmentalized with isolated fluid channels as represented by the vertical lines depicted in each heat exchanger block. These vertical lines represent separate gas flow channels for fluid isolating the different gases flowing through the heat exchanger from each other so that the only coupling of the gases in a heat exchanger is by thermal heat transfer from gas togas.

Natural gas streams 19 and 20 are fed separately into the first heat exchanger 22 of LNG generator 91 at ambient temperature for cooling. After cooling, the larger natural gas stream 19' is sent to a first process separator 23, generator 91. The stream 19' after processing by the separator 23 is expanded in expander 24 of generator 91 wherein the expansion cools the stream. The degree of cooling of stream 19' is a function of the pressure ratio through expander 24 with the temperature of stream 25 exiting the expander 24 assumed to be approximately minus 160° F. A natural gas stream with one mole percent $CO_2$ will start to freeze at approximately minus 171° F. and at a concentration of 1.5 mole percent will start to freeze at minus 167° F.

Since this freezing will interfere with throughput through the plant, the temperature of the gas stream 25 exiting the expander 24 is maintained above the freezing point. With a minus 160° F. discharge temperature, the expander 24 in this example needs a suction temperature of approximately minus 10° F. with the pressure ratio given.

The smaller stream 20 is processed by $CO_2$ adsorbers 21, 21 whose output streams 20' are inputted into heat exchanger 22 of generator 91 for chilling in fluid isolation from stream 19. The stream 20" at an output of heat exchanger 22 is inputted into a second cooling heat exchanger 31. This produces chilled stream 26 at an output of heat exchanger 31 corresponding to the inputted stream 20". The output stream 25 of the expander 24 is inputted into heat exchanger 31 and then sequentially as stream 25' into heat exchanger 22 for cooling the streams 19 and 20. A portion of the stream 19' output from separator 23, stream 19", is inputted into heat exchanger 22 and in fluid isolation in the heat exchanger 22 relative to the other streams. The streams 19" and 25' outputted from the heat exchanger 22 are combined into stream $\mathbf{22}_1$. This stream $\mathbf{22}_1$ is then combined with stream 43 to be discussed below for regeneration of one or both of dryers 18, 18 and then returned to the input stream low pressure side of letdown station 13 at junction 44.

As an alternate, $CO_2$ can be removed from stream 26. While removing the $CO_2$ at ambient temperature requires larger adsorbers and more energy, it does not waste refrigeration, which tends to be in short supply in most applications of this technology.

The energy recovered from expanding the natural gas in expander 24 is used to drive an electric generator brake 27 in this example. Alternate uses of this energy could be designed which utilize a compression brake on the expander 24 rather than electric generator brake 27. The generator brake 27, in the alternative, could be substituted with a compander (not shown) which could be used to compress nitrogen gas (for example, the compander may replace or assist any of the nitrogen compressors to be described below in the nitrogen liquefaction section), thus saving nitrogen compression energy. The compander could also be used to compress natural gas at either the higher or lower pressure levels of the natural gas distribution main stream 12 to increase the pressure ratio on the expander 24. This in turn increases the refrigeration capability of the letdown liquefaction unit 15. Placement of such a compander could be at stream 20, stream 19, stream 28 (at the outlet of air separation unit 45), or stream 30 applied to merchant gas liquefaction section 59.

After stream 20' is chilled in the first heat exchanger 22 and further chilled in the second heat exchanger 31 forming stream 26, the temperature of the resulting stream 26 is approximately minus 158° F. and, when throttled by control valve 32 results in a stream 33 having about 70% liquefied natural gas (LNG). This mixed phase stream 33 is sent to a second separator 34. The cold gas and liquid (LNG) are separated by separator 34. Pressure levels of the second separator 34 can be varied, but in this example the pressure is kept at 45 psig which results in a temperature of approximately minus 220° F. A portion of the LNG from the second separator 34 is remixed with the vapor exiting from the second separator 34 and fed into a third heat exchanger 35 in liquefaction section 59. The liquefaction section 59 comprises heat exchangers 35, 38 and 48, separator 50 and a throttling control valve between the output of the heat exchanger 48 and separator 50 to produce mixed phase streams. The separator 50 separates the vapor-liquid stream, forming liquid merchant gas stream 51.

The heat exchanger 35 produces natural gas output stream 41 from the outputs of separator 34 and, which after warming in this heat exchanger, is at ambient temperature. The remainder of the LNG from the second separator 34 is throttled at control valve 36 to generate a mixed phase stream 37 at a pressure of approximately 5 psig and results in a temperature of approximately minus 251° F. This mixed phase stream 37 is fed into a further separator 34' whose outputs are fed to liquefaction section 59 fourth heat exchanger 38 and then sequentially to the third heat exchanger 35 in which the gas is warmed to ambient temperature as stream 39. The output of heat exchanger 35 receiving the LNG from separator 34 is stream 41. The stream 39 exiting heat exchanger 35 is fed to compressor 40 whose output is combined with stream 41 forming stream 42.

In this example, the pressure levels only require compression of stream 39. However, with other systems, compression of both streams 39 and 41 may be required. A portion of the now recombined natural gas stream 42 is used to regenerate the carbon dioxide adsorption systems adsorbers 21, 21. The exiting stream 43 formed from the stream 42 feeds back into the natural gas distribution system as shown at junction 44 at a pressure level of 35 psig. Water dryers 18, 18 are regenerated by the gas returning from the heart exchanger 22 at stream $\mathbf{22}_1$.

The air separation unit 45 shown in FIG. 1 can either be a conventional nitrogen plant, common in the industrial gas industry; or it can be an oxygen plant that produces merchant gases such as oxygen and nitrogen, stream 52, or oxygen, stream 53, or argon, stream 54. The air separation unit 45 can be a self-supported plant from a refrigeration standpoint with one or more expanders providing the refrigeration. It could also be liquid assisted from the letdown liquefaction system 15 with liquid nitrogen, liquid oxygen or liquid argon and without an expansion system. In the present embodiment, liquid nitrogen is used to assist the air separation unit.

The air separation unit 45 is a refrigeration plant that produces liquid nitrogen, liquid oxygen and liquid argon from air. This is a balanced refrigeration system such that removal of any of the liquefied gases produces an in balance. Therefore, in order for the unit 45 to produce a merchant liquid gas such as nitrogen and so on that can be outputted from the unit, the liquid gas or gases needs to be replaced. The liquefaction system 15 performs this replacement function and generates the desired liquefied gas, preferably nitrogen, but could be any of the other gaseous components of air or air.

If the air separation unit 45 is a nitrogen plant, the pressure of stream 28, which is nitrogen gas, will vary between approximately 25 psig to 130 psig. If the air separation unit 45 is an oxygen plant producing nitrogen and argon as well as oxygen, the nitrogen of stream 28 will be close to atmospheric pressure (approximately 1 psig). In either case, the nitrogen stream 28 exiting the air separation unit 45 is compressed by compressor 46 and thereafter cooled and liquefied by the letdown liquefaction unit 15 nitrogen liquefaction section 59. Recycle nitrogen compressor 47 further compresses the nitrogen stream 29 combined with output nitrogen stream 35' from heat exchanger 35 to a pressure of from 400 psig to 1000 psig or more, but assumed to be 735 psig for this example which is a typical pressure level for conventional nitrogen expansion liquefiers. The compressed nitrogen gas stream 30 is cooled and chilled successively in heat exchangers 35, 38 and 48 in liquid nitrogen section 59 forming stream 49.

Stream 49 exiting heat exchanger 48 is cooled to approximately minus 247 F., and is flashed into conventional separator 50 at a control valve. The pressure level of separator 50 can also be varied depending upon the integration of the letdown liquefaction system 15 with the air separation unit 45. In this example, separator 50 is assumed to be at 90 psig. Nitrogen vapor from separator 50 at minus 281° F. is recycled back through heat exchangers 48, 38 and 35 sequentially forming stream 35' to recover its refrigeration before being recompressed in the recycle nitrogen compressor 47. The liquid nitrogen from separator 50 output stream 51 can be sent to tank 94 as product, but preferably in this embodiment is used to liquid assist the air separation unit 45 as discussed above. It should be understood that various valves in the fluid system for directing or closing off fluid streams are not shown for clarity of illustration.

Streams 52, 53 and 54 preferably respectively represent nitrogen, oxygen and argon exiting the air separation unit 45 after they have been liquid assisted by the letdown liquefaction system 15. In the alternative, any combination of streams 52, 53 and 54 may be withdrawn from the separation unit 45. In the example shown, an 80 ton per day air separation unit 45 is designed to produce 60 tons per day of liquid oxygen, 205 tons per day of liquid nitrogen and approximately 4 tons per day of liquid argon. All the refrigeration in this example is generated by the letdown liquefaction system 15. With approximately 45 million standard cubic feet per day ("SCFD") of natural gas sent through the letdown liquefaction system 15 at the pressure levels given, the power required to produce the above merchant liquid products is substantially reduced when compared to an air separation unit of any conventional nitrogen expansion liquefaction unit currently utilized by the industrial gas industry.

It should be understood that in FIG. 1 the number and positions of separators is given by way of example. There may be more or fewer such separators. Further, the particular number, configuration and position of heat exchangers is also by way of illustration. As shown in others of the figures below, a heat exchanger may be arranged to process a number of separate gases in different channels thereof. There may be more or fewer heat exchangers in the embodiment of FIG. 1 for a given set of functions. A single heat exchanger performing multiple stages of heat exchange is contemplated, the multiple separate heat exchangers in FIG. 1 being given by way of example. The above possible variations in the number and position and configuration of the heat exchangers is intended to be applicable both for natural gas processing as well as the liquefaction processing of the merchant gas such as nitrogen and so on.

In the above process, it is important that the $CO_2$ be removed only from the smaller stream of natural gas. This saves 5–10% power. Keeping the $CO_2$ in the entire natural gas stream during liquefaction of the natural gas results in the freezing up of the $CO_2$ and clogging of separators and so on resulting in a non-workable system. Removing $CO_2$ from all of the natural gas is wasteful of energy and utilizes excess power for such removal. Optimum efficiency thus results in removing the $CO_2$ only from the smaller natural gas stream as described.

Figure 2:
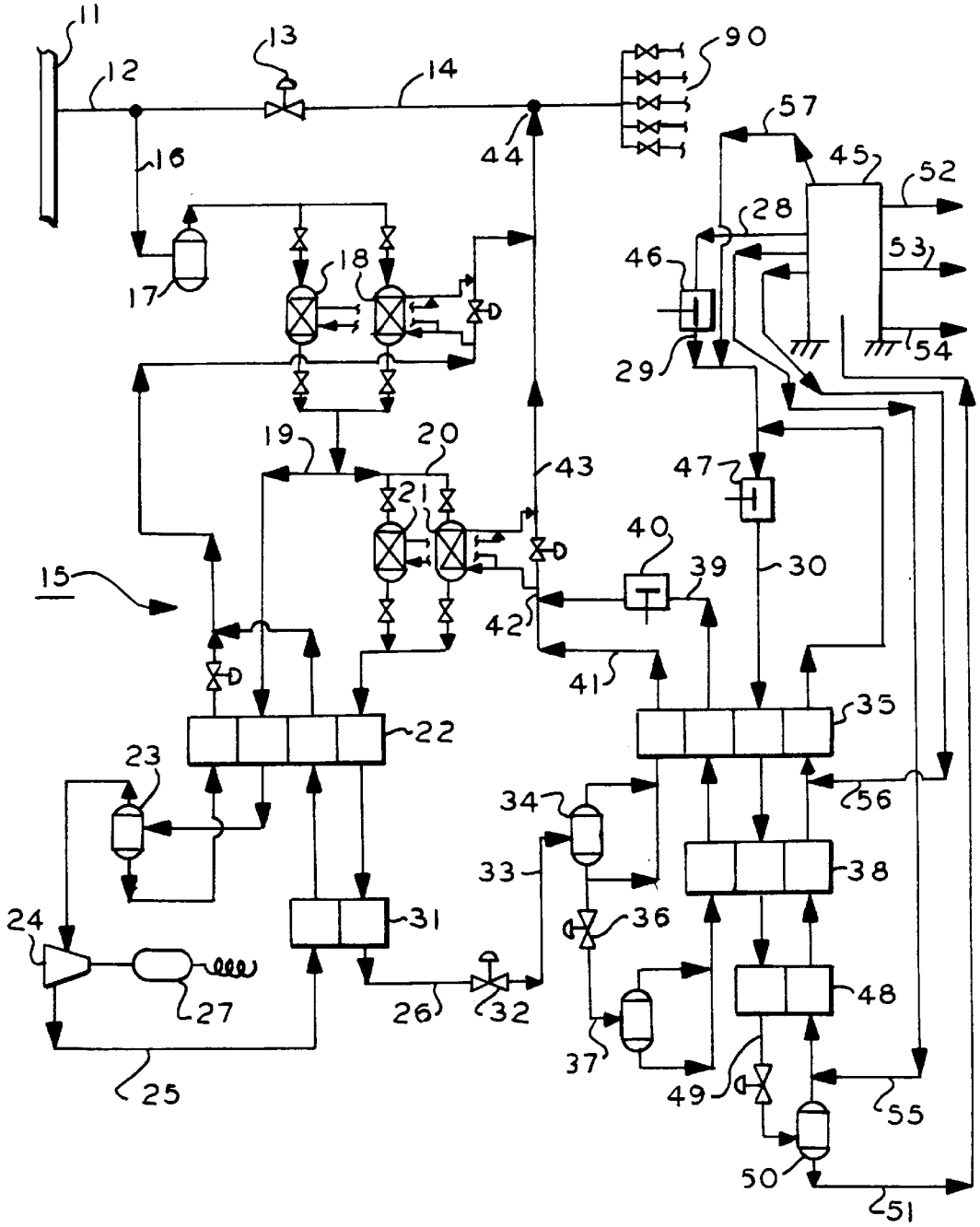
FIG. 2 is a schematic process flow diagram in accordance with the embodiment of FIG. 1 showing a letdown liquefaction plant employing makeup gas from the air separator unit, warm, low pressure nitrogen makeup, cold medium pressure nitrogen makeup and optionally, cold and/or warm, medium pressure makeup nitrogen from the air separation unit.

FIG. 2, illustrates several alternate integrations of the letdown liquefaction system 15 with the air separation unit 45. Parts with the same reference numerals in the figures represent identical parts. As in the case of the embodiment of the invention shown in FIG. 1, some of the makeup nitrogen feeding the letdown liquefaction system 15 can be close to atmospheric pressure and temperature as represented by the stream 28. Output stream 55 from unit 45 represents cold nitrogen gas at medium pressure and approximately minus 280° F. from the air separation unit 45 feeding heat exchanger 48 to complete the makeup nitrogen requirements. Intermediate temperature (approximately minus 150° F.) and pressure (approximately 90 psig) nitrogen stream 56 applied to heat exchanger 35 can also be utilized as partial makeup nitrogen feed. Warm ambient temperature/medium pressure nitrogen stream 57 can be utilized as partial makeup nitrogen and is applied to compressor 47 combined with stream 28 compressed in compressor 46. In some situations all the makeup nitrogen can be obtained from stream 57.

Oxygen gas from an oxygen plant could be substituted for nitrogen gas in these examples. While use of this gas is possible and falls within the scope of the claims appended hereto, it has not been illustrated because of its limited use due to safety concerns with processing natural gas and oxygen together in the letdown liquefaction system 15. The liquefaction of air is also possible and within the scope of the claims appended hereto with liquid air assist to the air separation unit, but it also has not been shown for the same reasons as oxygen. The liquefaction of argon is also possible and within the scope of the claims appended hereto with liquid air assist to the air separation unit, but it also has not been shown due to the small amount of argon available for use.

Figure 3:
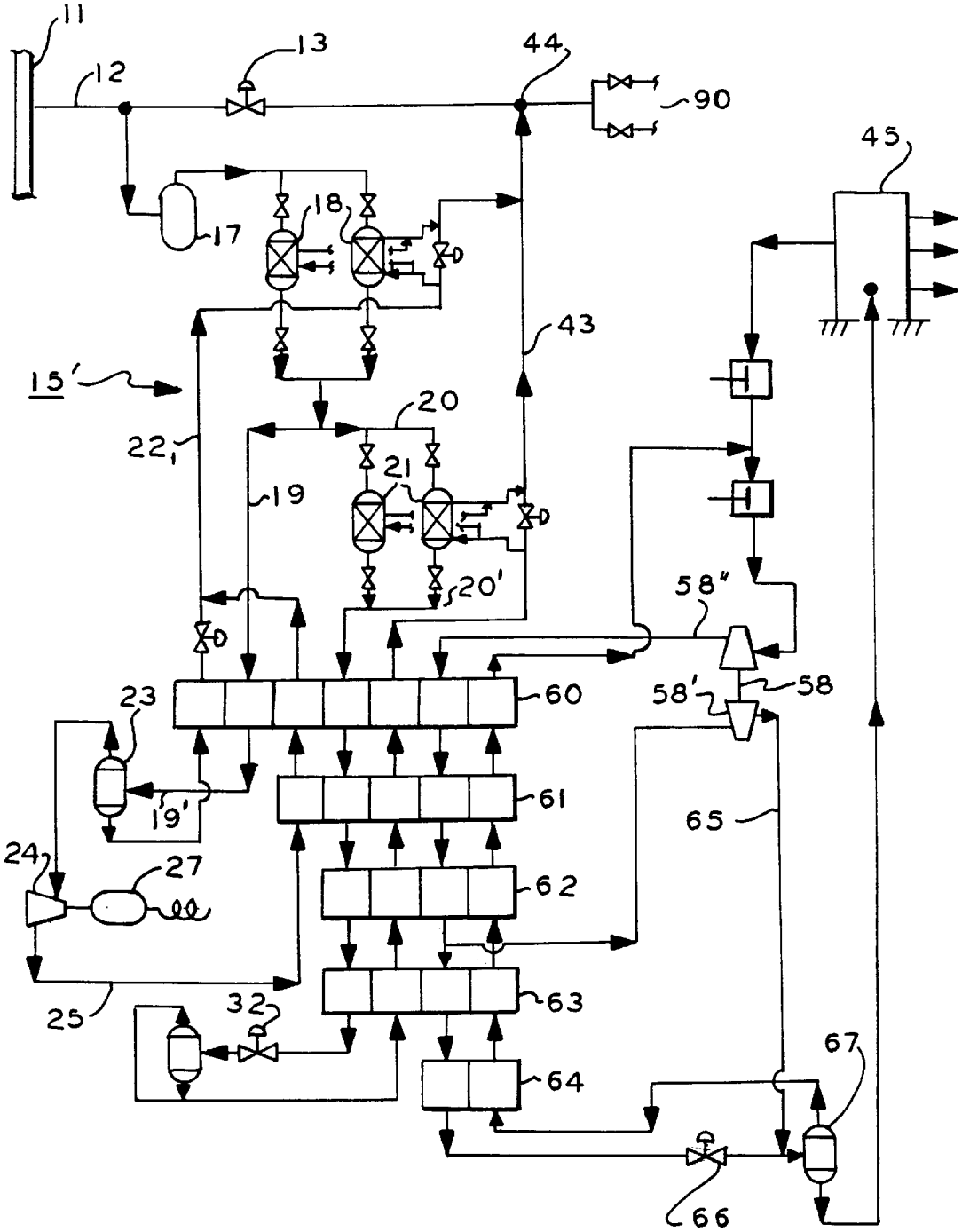
FIG. 3 is a schematic process flow diagram of a further embodiment showing the use of cold nitrogen expansion to augment the refrigeration capability of the natural gas wherein multiple optional integration's with the air separation unit are illustrated.

In FIG. 3, nitrogen expansion at a cold level is illustrated. Nitrogen expansion is used to augment the natural gas expansion refrigeration. If insufficient natural gas is available, nitrogen recycle compression can be increased and a nitrogen expander or compander 58 can be added to provide the extra refrigeration necessary to produce the desired merchant products. The natural gas is still processed in a letdown liquefaction system 15' as in the process shown in FIG. 1. The natural gas stream is split as before, and the smaller stream 20 has $CO_2$ removed. The exit temperature of the expander 24 natural gas is still around minus 160° F. The $CO_2$ free natural gas stream is still chilled and throttled to make LNG at valve 32, which in turn is used to refrigerate the high pressure natural gas applied through the heat exchangers 60–63. In this process, the energy from the nitrogen expansion is used in the compander 58 to drive the compressor brake of the expander section, compressing nitrogen up to final liquefaction pressure of 735 psig in stream 58". The heat transfer of stream 58" is handled successively in one bank of heat exchangers 60, 61. 62. 63 and 64, respectively, as illustrated with cold high pressure nitrogen at approximately minus 170° F. diverted to the nitrogen expander 58' from the corresponding output of heat exchanger 62 for expansion which at the pressure levels given in this case results in a nitrogen temperature at the discharge of the expander 58' output stream 65 of approximately minus 282° F. Some liquid nitrogen is made in the discharge of the expander 58' but most is still made by chilling and throttling the remaining high pressure nitrogen from heat exchanger 64 in control valve 66 into separator 67. This cycle is valuable when less natural gas is available to make the desired amounts of merchant gas products.

In FIG. 3, the nitrogen expander 58 suction can be moved up to a higher temperature level in the heat exchanger bank of exchangers 60–63 resulting in an increase of refrigeration for the same amount of nitrogen gas recycled. All these variations are possible in situations where somewhat less natural gas flow is available in comparison to the air separation unit size and merchant liquid product quantity desired.

Figure 4:
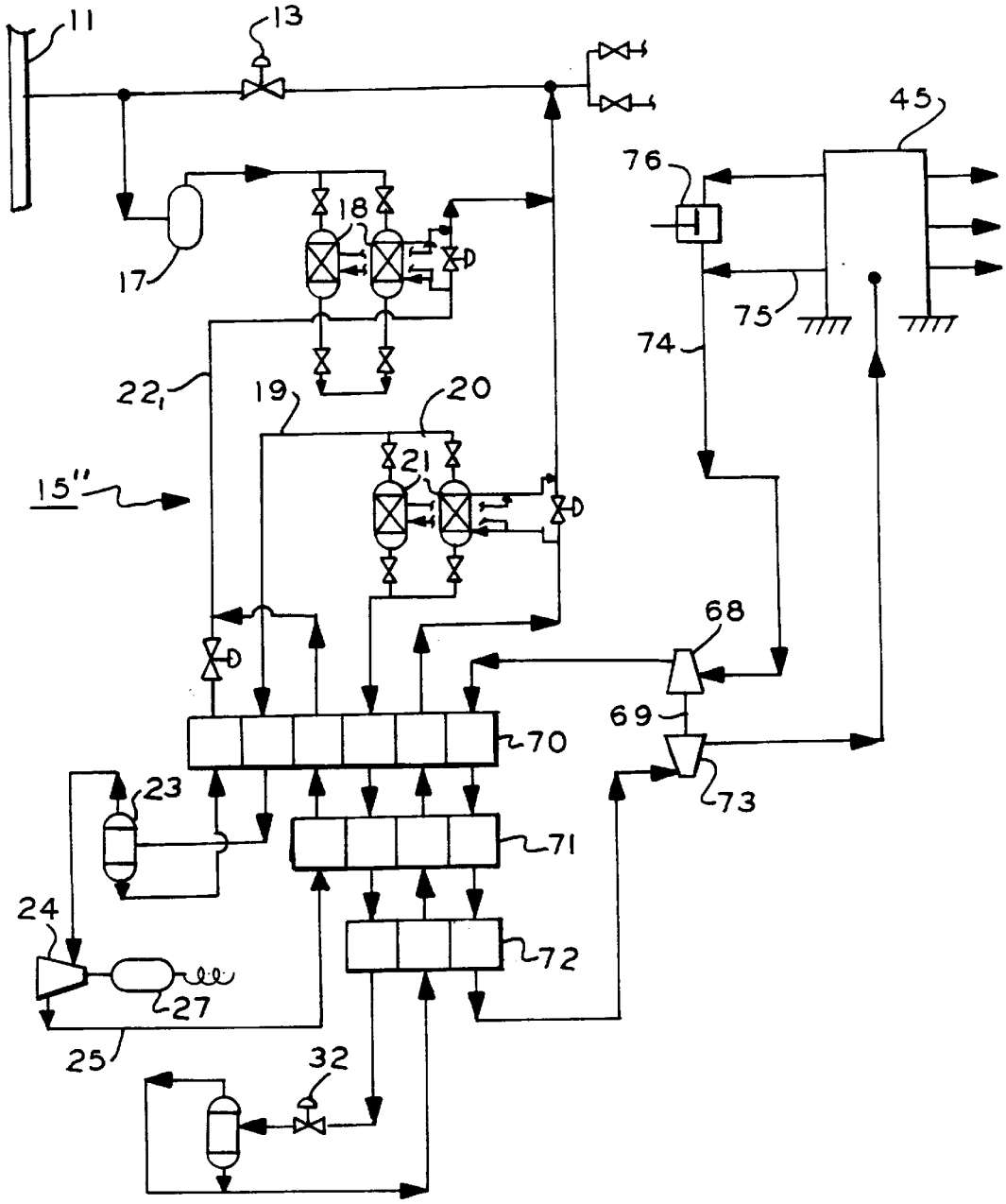
FIG. 4 is a schematic process flow diagram of a further embodiment showing a letdown plant directly refrigerating the air separation unit with cool nitrogen gas that enables merchant liquid product production from the air separation unit.

The process illustrated in FIG. 4 presents a processing scheme where the air separation unit 45 provides it's own refrigeration including the production of small quantities of liquid product. Both nitrogen and oxygen air separation units 45 are capable of this. A small letdown liquefaction system 15" can be integrated with the air separation unit 45 to take advantage of smaller natural gas letdown stations. In this example, nitrogen gas under the intermediate pressure (approximately 80 psig) is withdrawn from the air separator unit 45. The nitrogen gas may come off the air separator unit 45 at sufficient pressure as stream 75 or some or all of it may need to be compressed by nitrogen compressor 76 to obtain the proper pressure for stream 74. Nitrogen gas from the air separator unit 45 is passed to the compressor 68 of compander 69 and thence respectively through a bank of heat exchangers, 70, 71 and 72 to be cooled, and thence to the expander 73 of compander 69 and thence to the air separator unit 45. This enables an increase in the production of liquid products from the air separation unit. This process makes cold gas for return to the air separation unit 45 instead of liquid. Natural gas expansion is provided to cool the nitrogen stream exiting from the air separator unit 45 which requires much less natural gas. Advantage is taken of not only of the available natural gas pressure, but also extra gas available at pressure from the air separation unit 45. Power for the extra liquefaction is provided by an air compressor (not shown) in the air separation unit, but the power increase is small in comparison to the amount of liquid products produced.

Figure 5:
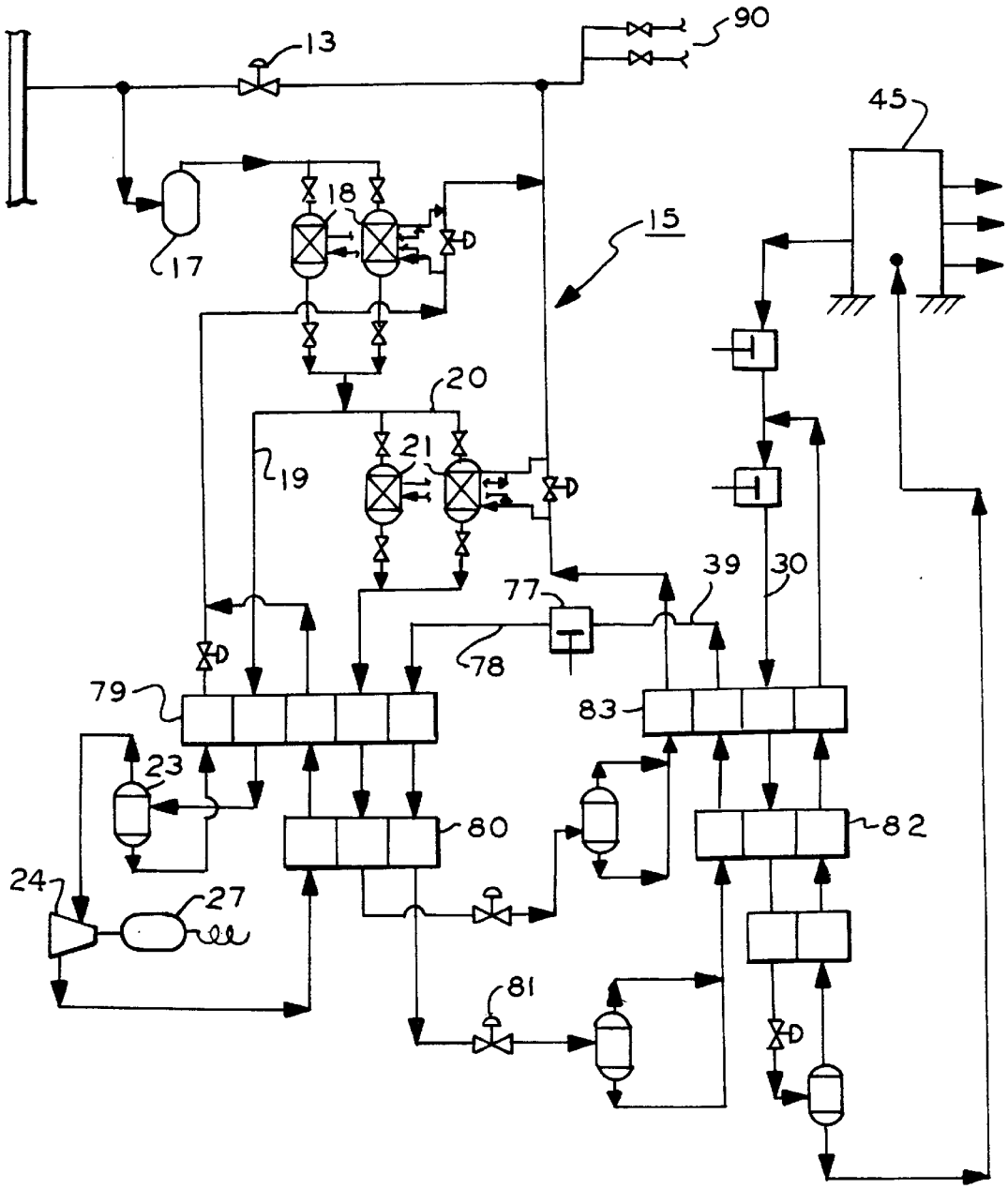
FIG. 5 is a schematic process flow diagram of still another embodiment of the invention where natural gas is recycled for use in recovering refrigeration.

In FIG. 5, an alternate arrangement of the base process of FIG. 1 is shown. Natural gas is intentionally recycled by a recycle methane compressor 77. The temperature and pressure levels set forth in the base cycle of FIG. 1 are kept approximately at the same as shown and described in the case of FIG. 5. However, natural gas from heat exchanger 83 is compressed by compressor 77 from approximately atmospheric pressure in stream 39, to somewhat over 700 psig forming stream 78. The recycled natural gas is flashed at control valve 81 to a lower pressure level resulting in the partial liquefaction of this stream. The recycled natural gas can then be used as additional refrigeration for heat exchangers 82 and 83 to cool the counter-flow nitrogen stream 30 before being recompressed in the recycle methane compressor 77. The natural gas from the letdown station 13 is used at a higher pressure level, which permits it to flow back into the natural gas pipeline without recompression. The power savings realized in the process shown in FIG. 5 is not as great as the savings realized in the process of FIG. 1, but for a given, fixed liquid nitrogen production target, the amount of natural gas needed to drive the letdown liquefaction plant 15, is less in the process shown in FIG. 5 than the process shown in FIG. 1.

It will occur to one of ordinary skill that various modifications may be made to the disclosed embodiments which are given by way of illustration and not limitation. For example, the merchant liquefied gases need not be returned to or supplied from an air separation unit. The merchant gas may be supplied from a separate gas source for liquefaction by the disclosed systems. Also, the gas returned to the air separation unit need not be liquid but may be in cold vapor form. The number, configuration and location of the various elements such as heat exchangers, separators, compressors, control valves and so on may differ from the embodiments disclosed as discussed above. It is intended that the scope of the invention is as defined in the appended claims.

What is claimed is:

1. A system for liquefying at least one of nitrogen, oxygen and argon merchant gas comprising:

natural gas liquefying means responsive to pressurized natural gas applied at an input thereto including first heat exchanger means for cooling the applied natural gas and including means for liquefying a first portion of the cooled natural gas including means for removing $CO_2$ solely from the first portion; and second heat exchanger means responsive to said liquefied first portion of gas applied as an input thereto for cooling and liquefying said at least one merchant gas applied to said second heat exchanger means.

2. The system of claim 1 wherein the natural gas liquefying means includes means for expanding and cooling by said expansion a second portion of said pressurized natural gas, said first heat exchanger means for receiving said first and second portions of said pressurized natural gas in fluid isolation relative to each other and responsive to said cooled second portion applied at an input thereto for cooling the first portion of said natural gas and means for liquefying said first portion and applying said cooled liquefied first portion to said second heat exchanger means.

3. The system of claim 2 wherein the first heat exchanger means comprises third and fourth heat exchangers each for receiving said first and second natural gas portions in fluid isolation relation relative to each other, said third and fourth heat exchangers for successively receiving said first and second portions for cooling the first portion with said cooled second portion.

4. The system of claim 3 wherein the third and fourth heat exchangers receive said second portion in reverse sequential order as the first portion.

5. The system of claim 3 wherein the natural gas input includes pressure letdown means for reducing the pressure of said input gas to a relatively low pressure output, said system including means for returning said first and second portions of gas to said low pressure output.

6. The system of claim 2 including separator means for separating liquids from said natural gas from said input, drying means for drying said separated natural gas and means for dividing said separated, dried gas into said first and second portions and adsorption means for adsorbing and removing $CO_2$ from said first dried portion.

7. The system of claim 6 including means for regenerating said drying and adsorption means with the cooled natural gas after warming by said first and second heat exchanger means.

8. The system of claim 1 wherein the second heat exchanger means includes a plurality of heat exchangers, the plurality of heat exchangers for successively receiving said at least one merchant gas to be liquefied and at least a portion of said plurality of heat exchangers for receiving the liquefied natural gas first portion for cooling the received at least one merchant gas.

9. The system of claim 8 wherein the plurality of heat exchangers includes at least two further heat exchangers for receiving the at least one merchant gas to be liquefied and for receiving the liquefied first portion.

10. The system of claim 9 wherein the at least two further heat exchangers comprise fifth, sixth and seventh heat exchangers, the fifth and sixth heat exchangers for receiving the liquefied natural gas for cooling and liquefying the at least one merchant gas in fluid isolation relation to the natural gas, the seventh heat exchanger for receiving only the at least one merchant gas.

11. The system of claim 10 including flash means for flashing the liquefied at least one merchant gas to produce vapor and liquid in the at least one merchant gas, separating means for separating said vapor from liquid in the at least one merchant gas and means for applying the separated vaporized at least one merchant gas to said seventh heat exchanger.

12. The system of claim 1 including air separation means for separating said at least one merchant gas from air, compression means for compressing the at least one merchant gas and means for supplying the compressed at least one merchant gas to said second heat exchanger means and for feeding the liquefied at least one merchant gas to said air separation means.

13. The system of claim 9 wherein the liquefied natural gas includes vapor and liquid natural gas and the second heat exchanger means comprises third and fourth heat exchangers, further including a first separator for separating the vapor from the liquid in said liquefied natural gas, means for applying the separated liquid natural gas to a second separator and means for applying the vapor and liquid natural gas from the first separator to the third heat exchanger and the output of the second separator to the fourth heat exchanger, a compressor for compressing the at least one merchant gas and for applying the compressed the at least one merchant gas to the third heat exchanger for cooling by said separated vapor and liquid natural gas and for applying the cooled merchant gas from the third heat exchanger to the fourth heat exchanger for cooling by said output of said second separator.

14. The system of claim 1 further including means for applying cooled said at least one merchant gas to said second heat exchanger means.

15. The system of claim 1 wherein the natural gas liquefying means includes a first expander means for expanding and cooling by a first expansion a second portion of said pressurized natural gas, said first heat exchanger means for receiving said first and second portions of said pressurized natural gas in fluid isolation relative to each other and responsive to said cooled second portion applied at an input thereto for cooling the first portion of said natural gas and means for liquefying said first portion and applying said liquefied first portion to said second heat exchanger means, said first heat exchanger means comprising first and second heat exchangers, further including a second expander for cooling by a second expansion said at least one merchant gas, said second heat exchanger means comprising third, fourth and fifth heat exchangers in combination with said first and second heat exchangers for successively cooling the at least one merchant gas, said second portion being applied to the first heat exchanger prior to said first expansion and successively to said second and first heat exchangers after the first expansion for successive cooling of the first and second portions of the natural gas and for successive cooling of the at least one merchant gas applied to the first and second heat exchangers, the liquefied natural gas being applied successively to the fourth, third, second and first heat exchangers for cooling the first portion of the natural gas and the at least one merchant gas in said fourth, third, second and first heat exchangers, and means for applying the cooled at least one merchant gas from the fourth heat exchanger to the fifth heat exchanger for liquefying the at least one merchant gas.

16. The system of claim 15 including flash means for flashing the liquefied natural gas first portion and applying the flashed liquefied natural gas first portion to the first heat exchanger successively through the fourth, third and second heat exchangers.

17. The system of claim 16 including means for expanding the at least one merchant gas output from the third heat exchanger and applying the latter expanded gas as a vapor to the input of the fifth heat exchanger for further cooling of the at least one merchant gas.

18. The system of claim 1 further including an air separation unit for providing said at least one merchant gas, said system including means for applying said liquefied at least one merchant gas to said separation unit for cooling said at least one merchant gas applied to said second heat exchanger means.

19. The system of claim 18 including compressor means for compressing said cooled said at least one merchant gas applied to said second heat exchanger means.

20. The system of claim 4 wherein the second heat exchanger means comprises fifth, sixth and seventh heat exchangers, the third, fourth, fifth and sixth exchangers for receiving the liquefied first portion of natural gas for cooling gas applied to said third, fourth, fifth and sixth heat exchangers, said means for liquefying the first portion for liquefying the first portion after it is successively passed through the third through sixth heat exchangers, and for applying the liquefied first portion to the sixth through third exchangers in reverse succession for said cooling, further including merchant gas expansion means for expanding the merchant gas to a reduced pressure and temperature and applying the expanded merchant gas to said third through seventh heat exchangers, the second heat exchanger means for receiving said at least one merchant gas in succession and for liquefying the at least one merchant gas and means for applying a cooling fluid to said seventh heat exchanger for cooling said applied at least one merchant gas.

21. The system of claim 20 including flashing means for creating cold vapor from the liquefied at least one merchant gas and means for applying the cold vapor to said third through seventh heat exchangers in reverse order as said at least one merchant gas.

22. The system of claim 20 including means for applying a portion of said at least one merchant gas passing through said third through fifth heat exchangers to said merchant gas expansion means for liquefying said portion of said at least one merchant gas.

23. The system of claim 21 including compression means for compression of said at least one merchant gas prior to applying said compressed at least one merchant gas to said expansion means.

24. The system of claim 20 including separator means for separating liquids from said natural gas from said input, drying means for drying said separated natural gas and means for dividing said separated, dried gas into said first and second portions and adsorption means for adsorbing and removing $CO_2$ from said first dried portion.

25. A system for liquefying at least one of nitrogen, oxygen and argon merchant gas supplied from an air separation unit which includes means for cooling the at least one merchant gas comprising:

natural gas liquefying means responsive to pressurized natural gas applied at an input thereto including heat exchanger means for cooling the applied natural gas and including means for liquefying a first portion of the cooled natural gas, said heat exchanger means including means responsive to said liquefied first portion of gas applied as an input thereto for cooling said at least one merchant gas applied to said heat exchanger means; and compander means for expanding the at least one merchant gas and for applying said expanded at least one merchant gas to said heat exchanger means for said cooling of said at least one merchant gas, said compander means for further expanding said cooled at least one merchant gas and applying said further expanded cooled at least one merchant gas to a separator for producing a cold at least one merchant gas and for applying the cold merchant gas to said air separation unit.

26. The system of claim 1 further including means for recycling natural gas between the first and second heat exchanger means.

27. The system of claim 26 including compressor means for compressing the recycled gas flowing from the second heat exchanger means to the first heat exchanger means.

28. The system of claim 26 including a throttle valve between the first and second heat exchanger means for cooling the natural gas exiting the first heat exchanger means prior to application to the second heat exchanger means.

29. The system of claim 26 wherein the natural gas liquefying means includes means for expanding and cooling by said expansion a second portion of said pressurized natural gas, said first heat exchanger means for receiving said first and second portions of said pressurized natural gas in fluid isolation relative to each other and responsive to said cooled second portion applied at an input thereto for cooling the first portion of said natural gas and means for liquefying said first portion and applying said cooled liquefied first portion to said second heat exchanger means.

30. The system of claim 29 wherein the first heat exchanger means comprises third and fourth heat exchangers each for receiving said first and second natural gas portions and said recycled natural gas in fluid isolation relation relative to each other, said third and fourth heat exchangers for successively receiving said first and second portions and said recycled natural gas for cooling said first portion.

* * * * *